US009613561B2

(12) United States Patent
Matsumoto

(10) Patent No.: US 9,613,561 B2
(45) Date of Patent: Apr. 4, 2017

(54) DISPLAY APPARATUS AND METHOD FOR CONTROLLING DISPLAY APPARATUS

(71) Applicant: NICHIA CORPORATION, Anan (JP)

(72) Inventor: Makoto Matsumoto, Itano-gun (JP)

(73) Assignee: NICHIA CORPORATION, Anan-shi (JP)

( * ) Notice: Subject to any disclaimer, the term of this patent is extended or adjusted under 35 U.S.C. 154(b) by 0 days.

(21) Appl. No.: 14/076,264

(22) Filed: Nov. 11, 2013

(65) Prior Publication Data

US 2014/0132492 A1 May 15, 2014

(30) Foreign Application Priority Data

Nov. 12, 2012 (JP) ..... 2012-248877
Jul. 31, 2013 (JP) ..... 2013-159449

(51) Int. Cl.
*G09G 3/32* (2016.01)

(52) U.S. Cl.
CPC ..... *G09G 3/32* (2013.01); *G09G 2300/06* (2013.01); *G09G 2310/0248* (2013.01); *G09G 2310/0275* (2013.01); *G09G 2320/0238* (2013.01)

(58) Field of Classification Search
CPC .. G09G 3/32; G09G 3/20; G09G 5/10; G09G 2310/0275; G09G 2320/0238; G09G 2310/0248; A63F 7/02
USPC ..... 345/76–77, 82–84, 204; 315/169.1–169.4; 313/463
See application file for complete search history.

(56) References Cited

U.S. PATENT DOCUMENTS

| | | | | |
|---|---|---|---|---|
| 5,973,456 | A * | 10/1999 | Osada et al. | 315/169.1 |
| 6,175,193 | B1 * | 1/2001 | Kishita et al. | 315/169.3 |
| 6,229,267 | B1 * | 5/2001 | Ushigusa et al. | 315/169.4 |
| 6,369,515 | B1 * | 4/2002 | Okuda | 315/169.3 |
| 6,486,607 | B1 * | 11/2002 | Yeuan | 315/169.1 |
| 6,985,124 | B1 | 1/2006 | Nogawa | |
| 7,598,949 | B2 * | 10/2009 | Han | 345/204 |
| 7,796,098 | B2 * | 9/2010 | Masumoto et al. | 345/76 |
| 7,808,456 | B2 * | 10/2010 | Chen et al. | 345/76 |
| 2004/0104686 | A1 * | 6/2004 | Shin et al. | 315/169.3 |
| 2005/0012698 | A1 * | 1/2005 | Takahashi | 345/77 |

(Continued)

FOREIGN PATENT DOCUMENTS

| | | |
|---|---|---|
| JP | 2001-109433 | 4/2001 |
| JP | 2002-091381 | 3/2002 |

(Continued)

*Primary Examiner* — Lun-Yi Lao
*Assistant Examiner* — Kelly B Hegarty
(74) *Attorney, Agent, or Firm* — Mori & Ward, LLP

(57) ABSTRACT

A display device includes a plurality of common lines, a plurality of drive lines, a plurality of light emitting elements, a source driver, and a sink driver. At least one charging device is connected to at least one of the common lines and configured to increase a voltage of the common lines to a predetermined value when the voltage of the common lines is lower than the predetermined value during a period while the source driver does not apply the voltage. At least one discharging device is connected to at least one of the plurality of common lines and configured to decrease the voltage of the common lines to the predetermined value when the voltage of the common lines is higher than the predetermined value during the period while the source driver does not apply the voltage.

17 Claims, 6 Drawing Sheets

(56) References Cited

U.S. PATENT DOCUMENTS

| | | | | |
|---|---|---|---|---|
| 2005/0030267 | A1 | 2/2005 | Tanghe et al. | |
| 2006/0139256 | A1* | 6/2006 | Adachi | 345/76 |
| 2013/0314307 | A1* | 11/2013 | Lin | G09G 3/32 345/82 |

FOREIGN PATENT DOCUMENTS

| | | |
|---|---|---|
| JP | 2005-055909 | 3/2005 |
| JP | 2005-156870 | 6/2005 |

* cited by examiner

DISPLAY APPARATUS AND METHOD FOR CONTROLLING DISPLAY APPARATUS

CROSS-REFERENCE TO RELATED APPLICATIONS

The present application claims priority under 35 U.S.C. §119 to Japanese Patent Application No. 2012-248877, filed Nov. 12, 2012 and Japanese Patent Application No. 2013-159449, filed Jul. 31, 2013. The contents of these applications are incorporated herein by reference in their entirety.

BACKGROUND

1. Technical Field

The present disclosure relates to a display apparatus and a method for controlling a display apparatus.

2. Description of the Related Art

Conventionally, a display apparatus has been proposed that discharges parasitic capacitance of a common line during a period while a voltage is not applied to the common line by a source driver, in order to prevent erroneous lighting of the light emitting elements due to the parasitic capacitance of the common line flowing into a drive line (refer to Japanese Patent Application Laid-open No. 2005-156870).

SUMMARY OF THE INVENTION

According to one aspect of the present invention, a display apparatus includes a plurality of common lines, a plurality of drive lines, a plurality of light emitting elements connected to the plurality of common lines and the plurality of drive lines, a source driver to apply a voltage to the plurality of common lines on a time-sharing basis, and a sink driver to draw a current from at least one drive line among the plurality of drive lines. The at least one drive line is connected to a light emitting element to be lighted-up among the plurality of light emitting elements. At least one charging device is connected to at least one of the plurality of common lines and is configured to increase a voltage of the at least one of the plurality of common lines to a predetermined value when the voltage of the at least one of the plurality of common lines is lower than the predetermined value during a period while the source driver does not apply the voltage. At least one discharging device is connected to at least one of the plurality of common lines and is configured to decrease the voltage of the at least one of the plurality of common lines to the predetermined value when the voltage of the at least one of the plurality of common lines is higher than the predetermined value during the period while the source driver does not apply the voltage.

According to another aspect of the present invention, a method for controlling a display apparatus includes applying, on a time-sharing basis, a voltage to a plurality of common lines connected to a plurality of light emitting elements of the display apparatus, drawing a current from at least one drive line among a plurality of drive lines connected to the plurality of light emitting elements. The at least one drive line is connected to a light emitting element to be lighted-up among the plurality of light emitting elements. A voltage of a connected common line connected to a charging device among the plurality of common lines is increased to a predetermined value when the voltage of the connected common line is lower than the predetermined value during a period while the voltage is not applied by a source driver. The voltage of the connected common line is decreased to the predetermined value when the voltage of the connected common line is higher than the predetermined value during the period while the voltage is not applied by the source driver.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF EMBODIMENTS

Hereinafter, embodiments will be explained with reference to the attached drawings.

[A Display Apparatus According to a First Embodiment]

Figure 1A:
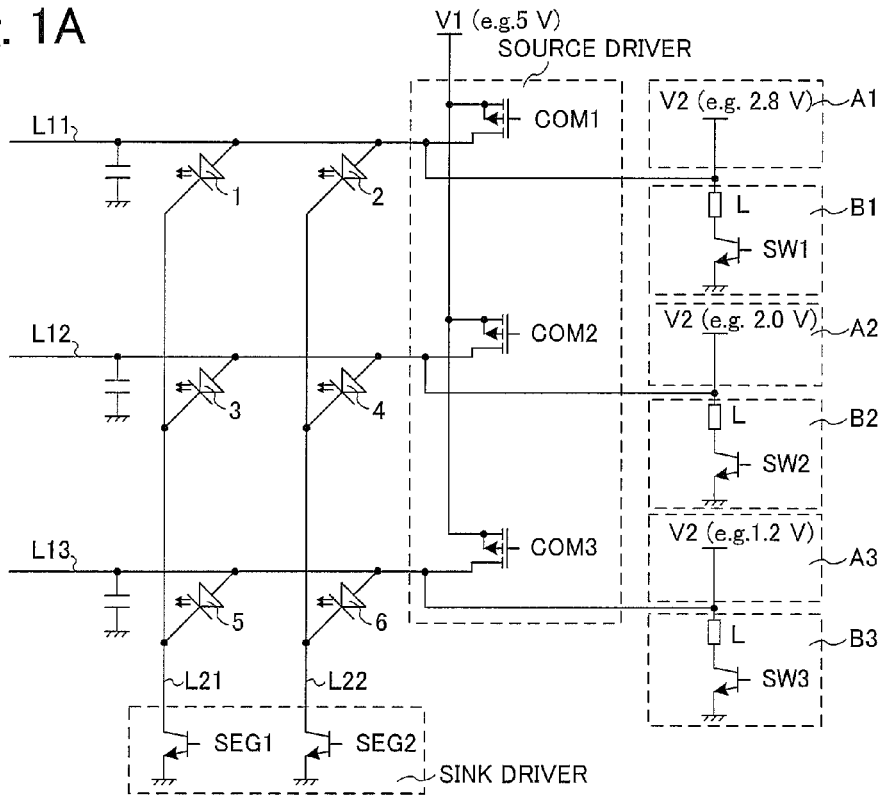
FIG. 1A is a circuit diagram and FIG. 1B is a timing chart of the display apparatus according to a first embodiment.
Figure 1B:
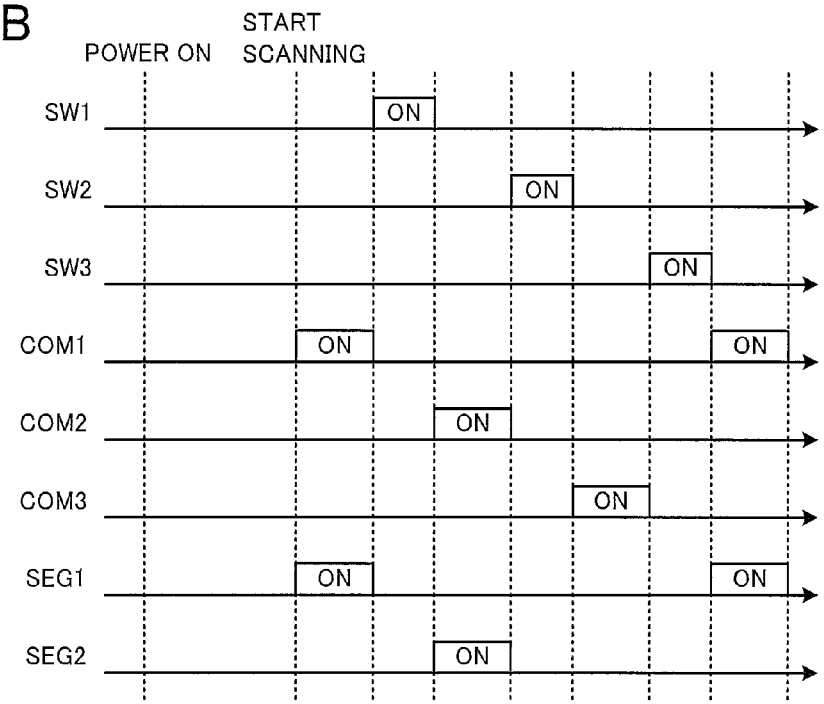

FIG. 1A is a circuit diagram and FIG. 1B is a timing chart of a display apparatus according to a first embodiment. "ON" in FIG. 1B means that both ends of a semiconductor switch are electrically connected (the switch is "closed").

As illustrated in FIGS. 1A and 1B, the display apparatus according to the first embodiment comprises a plurality of common lines L11 to L13, a plurality of drive lines L21 and L22, a plurality of light emitting elements 1 to 6 that are connected to the plurality of common lines L11 to L13 and the plurality of drive lines L21 and L22, a source driver that applies a voltage to the plurality of the common lines L11 to L13 on a time-sharing basis, and a sink driver that draws a current from one or more drive lines each of which is connected to a light emitting element to be lighted-up, out of the plurality of drive lines L21 and L22, charging devices A1 to A3 that are connected to the common lines L11 to L13 and increase the voltages of the connected common lines L11 to L13 to predetermined values when the voltages of the common lines L11 to L13 are lower than the predetermined values during a period while the voltage is not applied by the source driver, and discharging devices B1 to B3 that are connected to the common lines L11 to L13 and decreases the voltages of the connected common lines L11 to L13 to the predetermined values when the voltages of the common lines L11 to L13 are higher than the predetermined values during a period while the voltage is not applied by the source driver.

Hereinafter, an explanation will be given in order.

(A Plurality of Common Lines and a Plurality of Drive Lines)

Copper foil, for example, is used to form the plurality of common lines L11 to L13 and the plurality of drive lines L21 and L22. For example, a part of wiring of a printed circuit board corresponds to the common lines L11 to L13 and the drive lines L21 and L22.

(A Plurality of Light Emitting Elements)

A light emitting diode as illustrated in FIGS. 1A and 1B, for example, is used as each of the plurality of light emitting elements 1 to 6. The plurality of light emitting elements 1 to 6 are connected to the plurality of common lines L11 to L13 and the plurality of drive lines L21 and L22.

(Source Driver)

The source driver includes semiconductor switches COM1 to COM3, for example. Other than a P-channel field effect transistor (FET) as illustrated in FIGS. 1A and 1B, a PNP transistor and the like, for example, may be used to form each of the semiconductor switches COM1 to COM3 of the source driver. The source driver applies the voltage to the plurality of common lines L11 to L13 on the time-sharing basis by, for example, opening and closing the semiconductor switches COM1 to COM3 on the time-sharing basis and connecting the plurality of common lines L11 to L13 to a voltage supply unit V1 on the time-sharing basis. Incidentally, it is supposed in FIGS. 1A and 1B that the voltage supplied from the voltage supply unit V1 is 5 V as an example, in order to facilitate understanding by giving a concrete numerical value, but the voltage supplied from the voltage supply unit V1 is not limited to 5 V.

(Sink Driver)

The sink driver includes semiconductor switches SEG1 and SEG2, for example. Other than an NPN transistor as illustrated in FIGS. 1A and 1B, an N-channel FET and the like, for example, may be used to form each of the semiconductor switches SEG1 and SEG2 of the sink driver. The sink driver draws the current from one or more drive lines each of which is connected to a light emitting element to be lighted-up, out of the plurality of drive lines L21 and L22.

(Charging Device)

The charging devices A1 to A3 are connected to the common lines L11 to L13, and increase the voltages of the connected common lines L11 to L13 to the predetermined values when the voltages of the common lines L11 to L 13 are lower than the predetermined values during the period while the voltage is not applied by the source driver. According to the first embodiment, the charging devices A1 to A3 are respectively connected to the plurality of common lines L11 to L13.

Each of the charging devices A1 to A3 includes a voltage supply unit V2, for example. For example, a stabilized power supply such as a series regulator, a switching regulator (DC-DC converter) or the like may be used to form the voltage supply unit V2. It should be noted that, by allowing an input voltage of the stabilized power supply to have a value not lower than the voltage applied to the common line by the source driver, it is possible to prevent backflow of the current from the common lines L11 to L13 to the stabilized power supply. When the value of the input voltage of the stabilized power supply is lower than the voltage applied to the common line by the source driver, the backflow of the current from the common lines L11 to L13 to the stabilized power supply can be prevented by inserting a diode at any position between the stabilized power supply and the common lines L11 to L13.

The charging devices A1 to A3 do not include a semiconductor switch or the like between the voltage supply units V2 and the common lines L11 to L13, and the voltage supply units V2 are connected to the common lines L11 to L13 at all times. For this reason, the voltages of the common lines L11 to L13 are maintained at the predetermined values during a period from the time immediately after the display apparatus is turned on until when scanning of the common lines (application of the voltage by the source driver) is started. Incidentally, the period from the time immediately after the display apparatus is turned on until when the scanning of the common lines is started is an example of a period while the voltage is not applied by the source driver.

(Discharging Device)

The discharging devices B1 to B3 are connected to the common lines L11 to L13, and decrease the voltages of the connected common lines L11 to L13 to the predetermined values when the voltages of the common lines L11 to L13 are higher than the predetermined values during the period while the voltage is not applied by the source driver. According to the first embodiment of the present invention, the discharging devices B1 to B3 are respectively connected to the plurality of common lines L11 to L13.

The discharging devices B1 to B3 include, for example, semiconductor switches SW1 to SW3 (N-channel FETs or NPN transistors, for example). One ends of the semiconductor switches SW1 to SW3 are connected to the common lines L11 to L13 side, and another ends are connected to a ground side. When the voltages of the common lines L11 to L13 are decreased to the predetermined values, and then the semiconductor switches SW1 to SW3 are opened to cancel electrical connection between the charging devices A1 to A3 and the ground side, it is possible to prevent a useless current from flowing from the charging devices A1 to A3 to the discharging devices B1 to B3, and to reduce its power consumption.

(Load)

A load L, such as a resistance element, may be provided in each of the discharging devices B1 to B3. This makes it possible to prevent an excessive current from passing through the semiconductor switches of the discharging devices B1 to B3. Incidentally, it is also possible to provide the load L, such as the resistance element, in the charging devices A1 to A3. This also makes it possible to prevent the excessive current from passing through the semiconductor switches of the discharging devices B1 to B3.

(Operation)

With the display apparatus according to the first embodiment, as illustrated in FIG. 1B, the source driver starts to scan the common lines L11 to L13, after a lapse of a predetermined period of time after turning on the display apparatus. As the voltage supply units V2 of the charging devices A1 to A3 are connected to the common lines L11 to L13 at all times, the voltages of the common lines L11 to L13 are increased to have the predetermined values during the period from the time immediately after the display apparatus is turned on until when the scanning of the common lines L11 to L13 is started (one example of the period while the voltage is not applied by the source driver). Specifically, the voltage of the common line L11 is increased from 0 V to 2.8 V, the voltage of the common line L12 is increased from 0 V to 2.0 V, and the voltage of the common line L13 is increased from 0 V to 1.2 V.

When the scanning by the source driver is started, the voltage is applied to the plurality of common lines L11 to L13 on the time-sharing basis. Specifically, the semiconductor switches COM1 to COM3 open and close repeatedly with predetermined time intervals in the order of the semiconductor switch COM1, the semiconductor switch COM2, the semiconductor switch COM3, the semiconductor switch COM1, and so on, so that the voltage is applied to the plurality of common lines L11 to L13 in order.

The sink driver draws the current from one or more drive lines each of which is connected to a light emitting element to be lighted-up, out of the plurality of drive lines L21 and L22. In this case, it is supposed that the light emitting elements 1 and 4 are to be lighted-up. While the voltage is applied to the common line L11, the semiconductor switch SEG1 closes and the current is drawn from the drive line L21, and while the voltage is applied to the common line L12, the semiconductor switch SEG2 closes and the current is drawn from the drive line L22. Thus, the light emitting elements 1 and 4 are lighted up.

The semiconductor switch SW1 of the discharging device B1 closes during a period from when the source driver finishes the application of the voltage to the common line L11 until when it starts the application of the voltage to the common line L12 (one example of the period while the voltage is not applied by the source driver), that is, during a period from when the semiconductor switch COM1 closes until when the semiconductor switch COM2 opens. Thus, the voltage of the common line L11 is decreased to the predetermined value. Specifically, it is decreased from 5 V to 2.8 V.

Similarly, the semiconductor switch SW2 of the discharging device B2 closes during a period from when the source driver finishes the application of the voltage to the common line L12 until when it starts the application of the voltage to the common line L13 (one example of the period while the voltage is not applied by the source driver), that is, during a period from when the semiconductor switch COM2 closes until when the semiconductor switch COM3 opens. Thus, the voltage of the common line L12 is decreased to the predetermined value. Specifically, it is decreased from 5 V to 2.0 V.

Similarly, the semiconductor switch SW3 of the discharging device B3 closes during a period from when the source driver finishes the application of the voltage to the common line L13 until when it starts the application of the voltage to the common line L11 (one example of the period while the voltage is not applied by the source driver), that is, during a period from when the semiconductor switch COM3 closes until when the semiconductor switch COM1 opens. Thus, the voltage of the common line L13 is decreased to the predetermined value. Specifically, it is decreased from 5 V to 1.2 V.

According to the first embodiment as explained thus far, the voltages of the common lines L11 to L13 are maintained at the predetermined values by the charging devices A1 to A3 and the discharging devices B1 to B3, during the period while the voltage is not applied by the source driver. By allowing the predetermined values to be lower than the value of the voltage applied by the source driver, according to the first embodiment, it is possible to decrease the voltages of the common lines L11 to L13 moderately, not to decrease the voltages to almost zero, during the period while the voltage is not applied to the common lines L11 to L13 by the source driver. This makes it possible to prevent an excessive reverse voltage from being applied to the light emitting elements 1 to 6.

When the predetermined values are made too low, and when one of the light emitting elements (the light emitting element 4, for example) is short-circuited, the current erroneously flows from the common line (the common line L11, for example) to which the voltage is applied by the source driver, to the common line (the common line L12, for example) to which the short-circuited light emitting element (the light emitting element 4, for example) is connected and whose voltage is maintained at the predetermined value. Thus, the light emitting element (the light emitting element 2, for example) connected to the common line (the common line L11, for example) to which the voltage is applied by the source driver is erroneously lighted up. However, the erroneous lighting of the light emitting element (the light emitting element 2, for example) stops when the potential of the common line (the common line L12, for example) that is connected to the short-circuited light emitting element (the light emitting element 4, for example) is increased, and when a relational expression of "the voltage of the common line (the common line L11, for example) to which the voltage is applied by the source driver−the voltage of the common line (the common line L12, for example) connected to the short-circuited light emitting element (the light emitting element 4, for example)< a lighting voltage of the light emitting element (the light emitting element 2, for example)" is satisfied. Therefore, it is possible to stop the above-described erroneous lighting as quickly as possible by allowing the predetermined values to have values that are as high as possible (an example of the predetermined value) within a range where the value is lower than the lighting voltage of the light emitting element (the light emitting element 2, for example).

When the voltages of the common lines L11 to L13 are maintained at the predetermined values during the period while the voltage is not applied thereto by the source driver, and when the light emitting element to be lighted-up (the light emitting element 4, for example) suffers open failure, the current is erroneously drawn from the common line (the common line L11, for example) that is connected to the light emitting element (the light emitting element 2, for example) on the same drive line as the light emitting element (the light emitting element 4, for example) and that has the voltage maintained at the predetermined value. Thus, the light emitting element (the light emitting element 2, for example) that is on the same drive line as the light emitting element (the light emitting element 4, for example) suffering the open failure may be erroneously lighted up. However, the current flowing into the erroneously-lighted light emitting element (the light emitting element 2, for example) is nothing but the current supplied from the charging device (the charging device A1, for example). Therefore, it is possible to reduce or prevent the erroneous lighting by allowing the predetermined values to have values lower than the lighting voltage of the light emitting element (the light emitting element 2, for example) (one example of the predetermined values), as long as the value of the reverse voltage is within the permissible range.

It should be noted that, according to the first embodiment, the predetermined value that the common line L11 maintains is 2.8 V, the predetermined value that the common line L12 maintains is 2.0 V, and the predetermined value that the common line L13 maintains is 1.2 V, as one example. When the common lines are allowed to have the various predetermined values like this, it is possible for the respective common lines to choose which of measures should be taken with higher priority, out of the measure against the erroneous lighting due to the short-circuit failure and the measure against the erroneous lighting due to the open failure.

[A Display Apparatus According to a Second Embodiment]

Figure 2A:
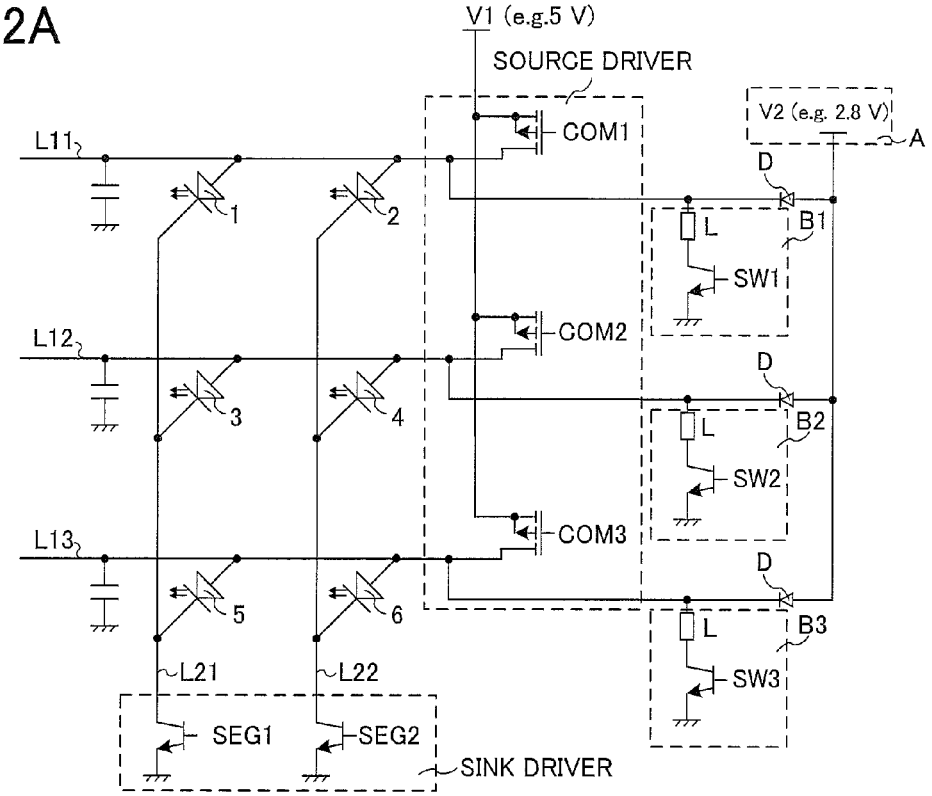
FIG. 2A is a circuit diagram and FIG. 2B is a timing chart of the display apparatus according to a second embodiment.
Figure 2B:
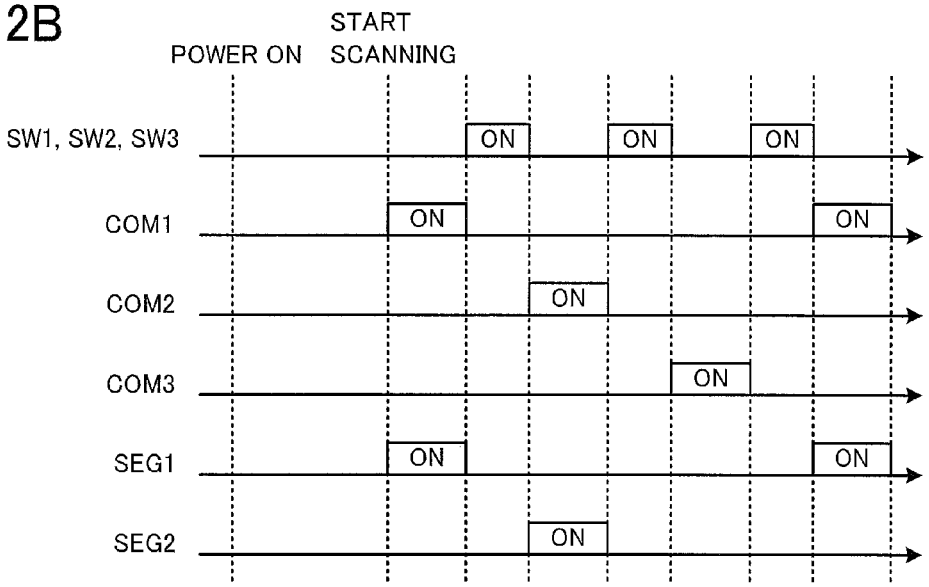

FIG. 2A is a circuit diagram and FIG. 2B is a timing chart of the display apparatus according to a second embodiment. "ON" in FIG. 2B means that the both ends of the semiconductor switch are electrically connected (the switch is "closed").

As illustrated in FIGS. 2A and 2B, the display apparatus according to the second embodiment has a charging device A to which the plurality of common lines L11 to L13 are connected, and is different from the display apparatus according to the first embodiment in which the charging devices A1 to A3 are respectively connected to the plurality of common lines L11 to L13. Similarly to the display apparatus according to the first embodiment, it is also possible for the display apparatus according to the second embodiment to decrease the voltages of the common lines L11 to L13 moderately, not to decrease the voltages to almost zero, during the period while the voltage is not applied to the common lines by the source driver. This makes it possible to prevent the excessive reverse voltage from being applied to the light emitting elements 1 to 6.

It should be noted that, according to the second embodiment, the predetermined value at which the common lines L11 to L13 are maintained is supposed to be 2.8 V, as one example.

In addition, diodes D are provided between the charging device A and the common lines L11 to L13. The diode D prevents the current from flowing from the common line (the common line L12, for example), to which the voltage is applied by the source driver, to the common line (the common line L11, for example), whose voltage is maintained at the predetermined value.

(Operation)

With the display apparatus according to the second embodiment, as illustrated in FIG. 2B, the source driver starts to scan the common lines L11 to L13, after the lapse of the predetermined period of time after turning on the display apparatus. As the voltage supply unit V2 of the charging device A is connected to the common lines L11 to L13 at all times, the voltages of the common lines L11 to L13 are increased to have the predetermined value during the period from the time immediately after the display apparatus is turned on until when the scanning of the common lines is started (one example of the period while the voltage is not applied by the source driver). Specifically, the voltages of the common lines L11 to L13 are increased from 0 V to 2.8 V.

When the scanning by the source driver is started, the voltage is applied to the plurality of common lines L11 to L13 on the time-sharing basis. Specifically, the semiconductor switches COM1 to COM3 open and close repeatedly with the predetermined time intervals in the order of the semiconductor switch COM1, the semiconductor switch COM2, the semiconductor switch COM3, the semiconductor switch COM1, and so on, so that the voltage is applied to the plurality of common lines L11 to L13 in order.

The sink driver draws the current from one or more drive lines each of which is connected to a light emitting element to be lighted-up, out of the plurality of drive lines L21 and L22. In this case, it is supposed that the light emitting elements 1 and 4 are to be lighted-up. While the voltage is applied to the common line L11, the semiconductor switch SEG1 closes and the current is drawn from the drive line L21, and while the voltage is applied to the common line L12, the semiconductor switch SEG2 closes and the current is drawn from the drive line L22. Thus, the light emitting elements 1 and 4 are lighted up.

The semiconductor switches SW1 to SW3 of the discharging devices B1 to B3 close during a period from when the source driver finishes the application of the voltage to any of the common lines L11 to L13 until when it starts the application of the voltage to any of the common lines L11 to L13 (one example of the period while the voltage is not applied to the common lines by the source driver), that is, during a period from when any of the semiconductor switches COM1 to COM3 closes until when any of the semiconductor switches COM1 to COM3 opens. Thus, the voltages of the common lines L11 to L13 are decreased to the predetermined value. Alternatively, the voltages of the common lines L11 to L13 are maintained at the predetermined value. Specifically, the voltages are decreased from 5 V to 2.8 V. Alternatively, the voltages are maintained at 2.8 V.

[A Display Apparatus According to a Third Embodiment]

Figure 3A:
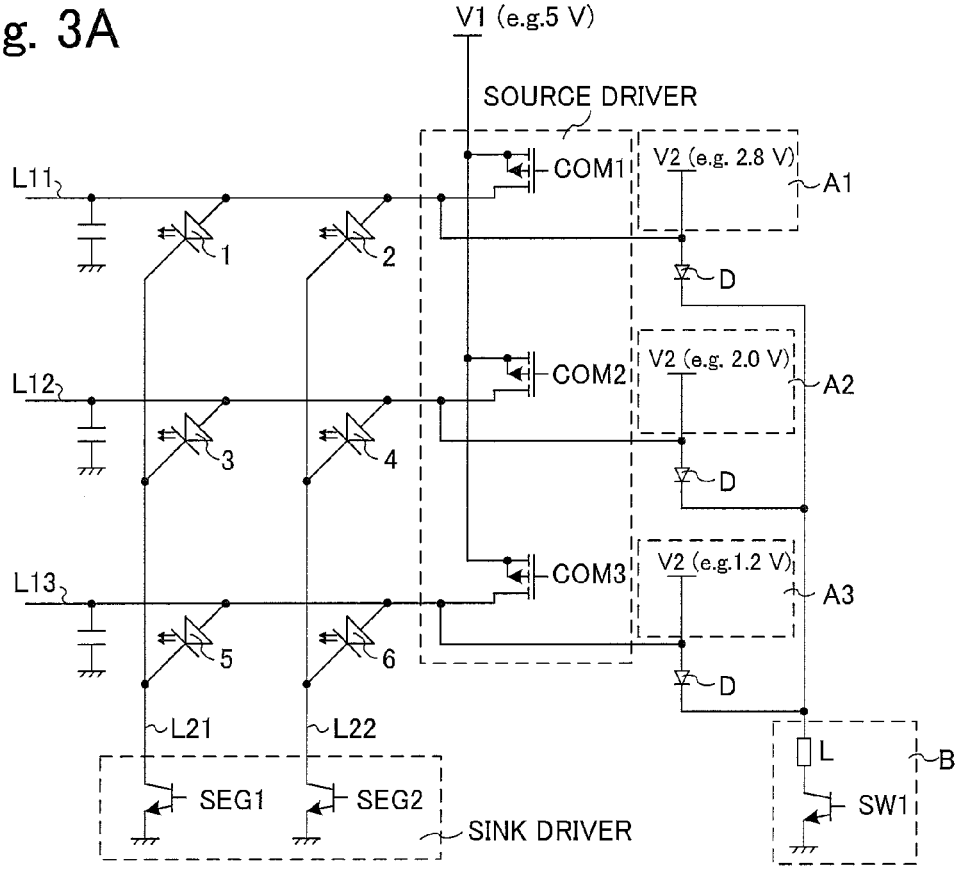
FIG. 3A is a circuit diagram and FIG. 3B is a timing chart of the display apparatus according to a third embodiment.
Figure 3B:
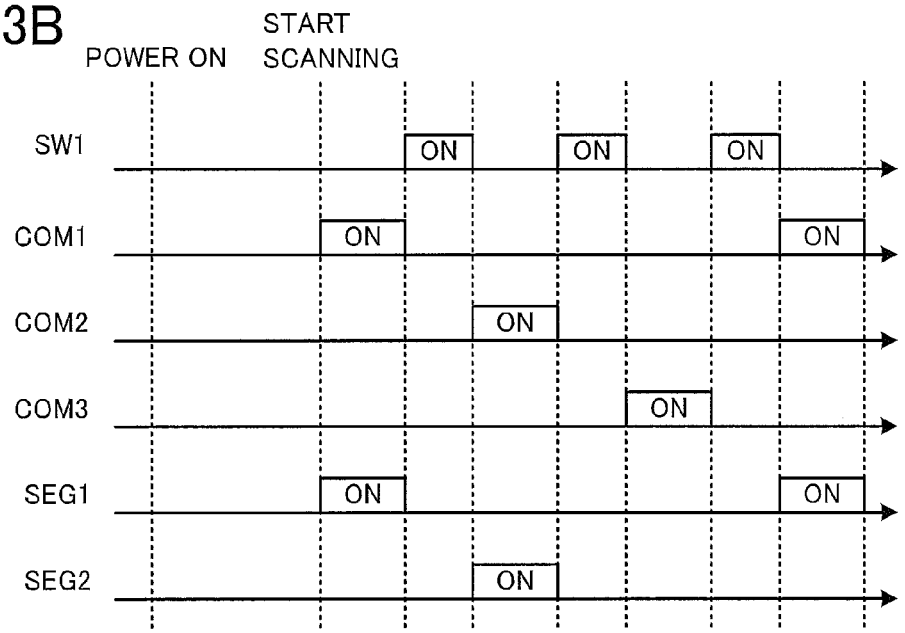

FIG. 3A is a circuit diagram and FIG. 3B is a timing chart of the display apparatus according to a third embodiment. "ON" in FIG. 3B means that the both ends of the semiconductor switch are electrically connected (the switch is "closed").

As illustrated in FIGS. 3A and 3B, the display apparatus according to the third embodiment has a discharging device B to which the plurality of common lines L11 to L13 are connected, and is different from the display apparatus according to the first embodiment in which the plurality of common lines L11 to L13 are respectively connected to the discharging devices B1 to B3. Similarly to the display apparatus according to the first embodiment, it is also possible for the display apparatus according to the third embodiment to decrease the voltages of the common lines L11 to L13 moderately, not to decrease the voltages to almost zero, during the period while the voltage is not applied to the common lines L11 to L13 by the source driver. This makes it possible to prevent the excessive reverse voltage from being applied to the light emitting elements 1 to 6.

Incidentally, the diodes D are provided between the charging devices A1 to A3 and the discharging device B. The diode D prevents the current from flowing from the common line (the common line L12, for example), to which the voltage is applied by the source driver, to the common line (the common line L11, for example), whose voltage is maintained at the predetermined value.

(Operation)

With the display apparatus according to the third embodiment, as illustrated in FIG. 3B, the source driver starts to scan the common lines L11 to L13, after the lapse of the predetermined period of time after turning on the display apparatus. As the voltage supply units V2 of the charging devices A1 to A3 are connected to the common lines L11 to L13 at all times, the voltages of the common lines L11 to L13 are increased to have the predetermined values during the period from the time immediately after the display apparatus is turned on until when the scanning of the common lines is started (one example of the period while the voltage is not applied by the source driver). Specifically, the voltage of the common line L11 is increased from 0 V to 2.8 V, the voltage of the common line L12 is increased from 0 V to 2.0 V, and the voltage of the common line L13 is increased from 0 V to 1.2 V.

When the scanning by the source driver is started, the voltage is applied to the plurality of common lines L11 to L13 on the time-sharing basis. Specifically, the semiconductor switches COM1 to COM3 open and close repeatedly with the predetermined time intervals in the order of the semiconductor switch COM1, the semiconductor switch COM2, the semiconductor switch COM3, the semiconductor switch COM1, and so on, so that the voltage is applied to the plurality of common lines L11 to L13 in order.

The sink driver draws the current from one or more drive lines each of which is connected to a light emitting element to be lighted-up, out of the plurality of drive lines L21 and L22. In this case, it is supposed that the light emitting elements 1 and 4 are to be lighted-up. While the voltage is applied to the common line L11, the semiconductor switch SEG1 closes and the current is drawn from the drive line L21, and while the voltage is applied to the common line L12, the semiconductor switch SEG2 closes and the current is drawn from the drive line L22. Thus, the light emitting elements 1 and 4 are lighted up.

The semiconductor switch SW1 of the discharging device B closes during the period from when the source driver finishes the application of the voltage to any of the common lines L11 to L13 until when it starts the application of the voltage to any of the common lines L11 to L13 (one example of the period while the voltage is not applied to the common lines by the source driver), that is, during the period from when any of the semiconductor switches COM1 to COM3 closes until when any of the semiconductor switches COM1 to COM3 opens. Thus, the voltages of the common lines L11 to L13 are decreased to the predetermined values, or maintained at the predetermined values. Specifically, the voltage of the common line L11 is decreased from 5 V to 2.8 V, or maintained at 2.8 V. Further, the voltage of the common line L12 is decreased from 5 V to 2.0 V, or maintained at 2.0 V. Furthermore, the voltage of the common line L13 is decreased from 5 V to 1.2 V, or maintained at 1.2 V.

[A Display Apparatus According to a Fourth Embodiment]

Figure 4A:
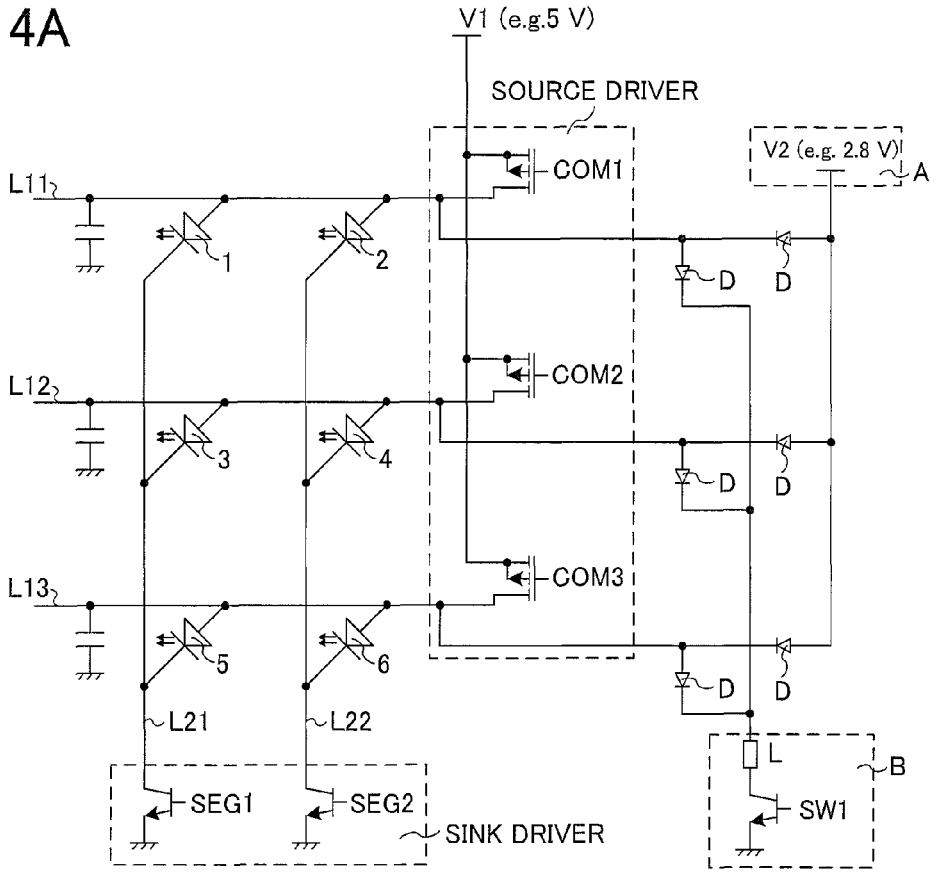
FIG. 4A is a circuit diagram and FIG. 4B is a timing chart of the display apparatus according to a fourth embodiment.
Figure 4B:
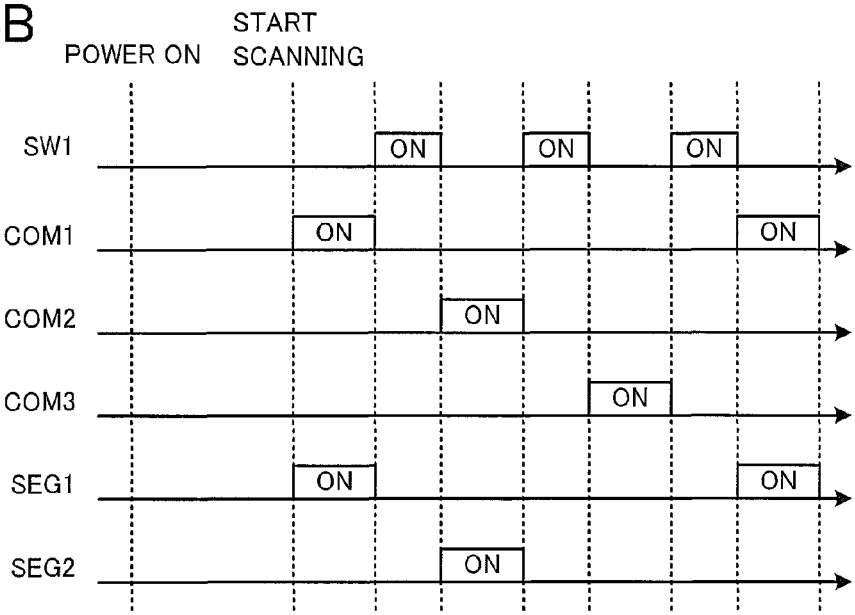

FIG. 4A is a circuit diagram and FIG. 4B is a timing chart of the display apparatus according to a fourth embodiment. "ON" in FIG. 4B means that the both ends of the semiconductor switch are electrically connected (the switch is "closed").

As illustrated in FIGS. 4A and 4B, the display apparatus according to the fourth embodiment has the charging device A and the discharging device B to which the plurality of common lines L11 to L13 are connected, and is different from the display apparatus according to the first embodiment in which the charging devices A1 to A3 and the discharging devices B1 to B3 are respectively connected to the plurality of common lines L11 to L13. Similarly to the display apparatus according to the first embodiment, it is also possible for the display apparatus according to the fourth embodiment to decrease the voltages of the common lines L11 to L13 moderately, not to decrease the voltages to almost zero, during the period while the voltage is not applied to the common lines by the source driver. This makes it possible to prevent the excessive reverse voltage from being applied to the light emitting elements 1 to 6.

It should be noted that, according to the fourth embodiment, the predetermined value at which the common lines L11 to L13 are maintained is supposed to be 2.8 V, as one example.

In addition, the diodes D are respectively provided between the charging device A and the discharging device B, and between the charging device A and the common lines L11 to L13. The diode D prevents the current from flowing from the common line (the common line L12, for example), to which the voltage is applied by the source driver, to the common line (the common line L11, for example), whose voltage is maintained at the predetermined value.

(Operation)

With the display apparatus according to the fourth embodiment, as illustrated in FIG. 4B, the source driver starts to scan the common lines L11 to L13, after the lapse of the predetermined period of time after turning on the display apparatus. As the voltage supply unit V2 of the charging device A is connected to the common lines L11 to L13 at all times, the voltages of the common lines L11 to L13 are increased to have the predetermined value during the period from the time immediately after the display apparatus is turned on until when the scanning of the common lines is started (one example of the period while the voltage is not applied by the source driver). Specifically, the voltages of the common lines L11 to L13 are increased from 0 V to 2.8 V.

When the scanning by the source driver is started, the voltage is applied to the plurality of common lines L11 to L13 on the time-sharing basis. Specifically, the semiconductor switches COM1 to COM3 open and close repeatedly with predetermined time intervals in the order of the semiconductor switch COM1, the semiconductor switch COM2, the semiconductor switch COM3, the semiconductor switch COM1, and so on, so that the voltage is applied to the plurality of common lines L11 to L13 in order.

The sink driver draws the current from one or more drive lines each of which is connected to a light emitting element to be lighted-up, out of the plurality of drive lines L21 and L22. In this case, it is supposed that the light emitting elements 1 and 4 are to be lighted-up. While the voltage is applied to the common line L11, the semiconductor switch SEG1 closes and the current is drawn from the drive line L21, and while the voltage is applied to the common line L12, the semiconductor switch SEG2 closes and the current is drawn from the drive line L22. Thus, the light emitting elements 1 and 4 are lighted up.

The semiconductor switch SW1 of the discharging device B closes during the period from when the source driver finishes the application of the voltage to any of the common lines L11 to L13 until when it starts the application of the voltage to any of the common lines L11 to L13 (one example of the period while the voltage is not applied to the common lines by the source driver), that is, during the period from when any of the semiconductor switches COM1 to COM3 closes until when any of the semiconductor switches COM1 to COM3 opens. Thus, the voltages of the common lines L11 to L13 are decreased to the predetermined value, or maintained at the predetermined value. Specifically, the voltages are decreased from 5 V to 2.8 V, or maintained at 2.8 V.

[A Display Apparatus According to a Fifth Embodiment]

Figure 5A:
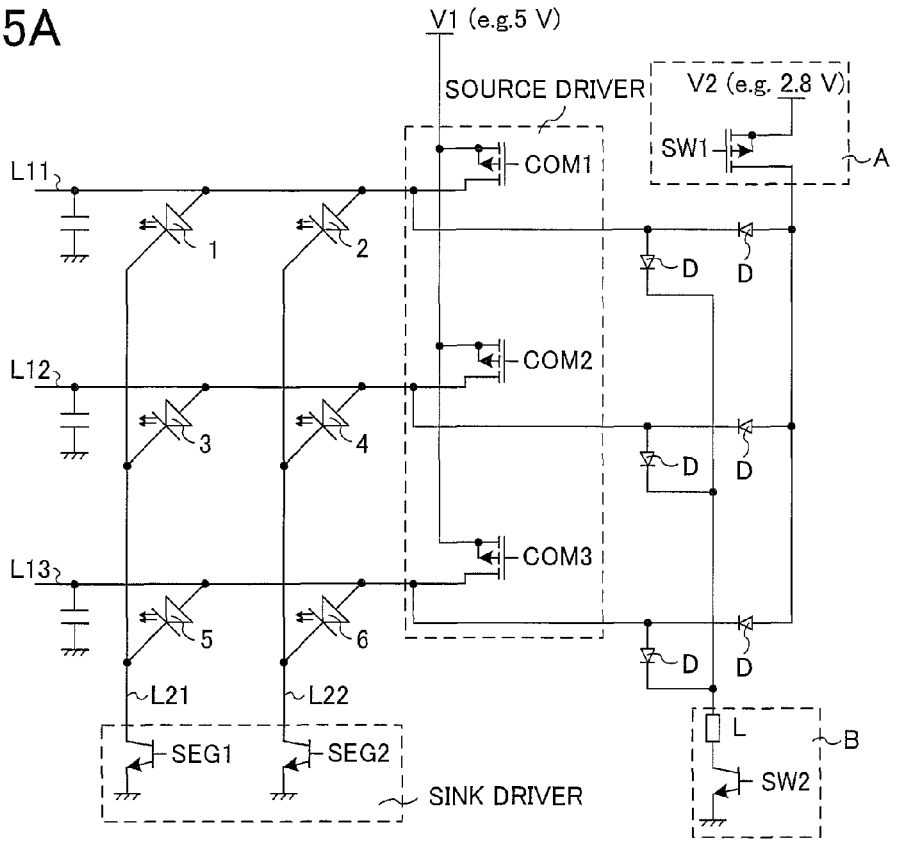
FIG. 5A is a circuit diagram and FIG. 5B is a timing chart of the display apparatus according to a fifth embodiment.
Figure 5B:
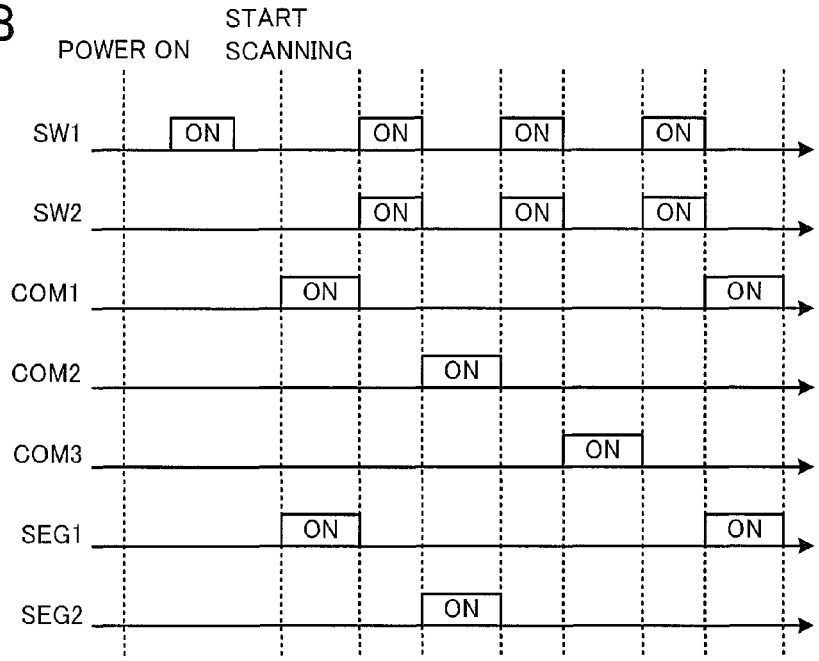

FIG. 5A is a circuit diagram and FIG. 5B is a timing chart of the display apparatus according to a fifth embodiment. "ON" in FIG. 5B means that the both ends of the semiconductor switch are electrically connected (the switch is "closed").

As illustrated in FIGS. 5A and 5B, the display apparatus according to the fifth embodiment has a semiconductor switch SW1 connected between the voltage supply unit V2 of the charging device A and the common lines L11 to L13, and is different from the display apparatus according to the fourth embodiment that does not have the semiconductor switch connected between the voltage supply unit V2 and the common lines L11 to L13. Similarly to the display apparatus according to the fourth embodiment, it is also possible for the display apparatus according to the fifth embodiment to decrease the voltages of the common lines L11 to L13 moderately, not to decrease the voltages to almost zero, during the period while the voltage is not applied to the common lines by the source driver. This makes it possible to prevent the excessive reverse voltage from being applied to the light emitting elements 1 to 6.

As illustrated in FIG. 5B, the semiconductor switch SW1 is closed at least once during the period from the time immediately after the display apparatus is turned on until when the scanning of the common lines (the application of the voltage by the source driver) is started. Thereby, the voltages of the common lines L11 to L13 are maintained at the predetermined value during the period from the time immediately after the display apparatus is turned on until when the scanning of the common lines (the application of the voltage by the source driver) is started. This also makes it possible to prevent the excessive reverse voltage from being applied to the light emitting elements 1 to 6 during this period.

With the display apparatus according to the fifth embodiment, the voltages of the common lines L11 to L13 gradually decrease due to self-discharging and a leakage current, during a period while the voltage is not applied to the common lines by the source driver and while the semiconductor switch SW1 opens. However, before the voltages of the common lines L11 to L13 decrease substantially, the semiconductor switch SW1 closes again and the voltages of the common lines L11 to L13 are increased again. Therefore, with the display apparatus according to the fifth embodiment, the voltages of the common lines L11 to L13 are maintained at the predetermined value, although a maintaining degree is somewhat different from those of the display apparatuss according to the first to the fourth embodiments.

(Operation)

With the display apparatus according to the fifth embodiment, as illustrated in FIG. 5B, the semiconductor switch SW1 of the charging device A closes during the period from when the display apparatus is turned on until when the scanning of the common lines L11 to L13 by the source driver is started. Thereby, the voltages of the common lines L11 to L13 are increased to have the predetermined value during the period from the time immediately after the display apparatus is turned on until when the scanning of the common lines is started (one example of the period while the voltage is not applied by the source driver). Specifically, the voltages of the common lines L11 to L13 are increased from 0 V to 2.8 V.

When the scanning by the source driver is started, the voltage is applied to the plurality of common lines L11 to L13 on the time-sharing basis. Specifically, the semiconductor switches COM1 to COM3 open and close repeatedly with the predetermined time intervals in the order of the semiconductor switch COM1, the semiconductor switch COM2, the semiconductor switch COM3, the semiconductor switch COM1, and so on, so that the voltage is applied to the plurality of common lines L11 to L13 in order.

The sink driver draws the current from one or more drive lines each of which is connected to a light emitting element to be lighted-up, out of the plurality of drive lines L21 and L22. In this case, it is supposed that the light emitting elements 1 and 4 are to be lighted-up. While the voltage is applied to the common line L11, the semiconductor switch SEG1 closes and the current is drawn from the drive line L21, and while the voltage is applied to the common line L12, the semiconductor switch SEG2 closes and the current is drawn from the drive line L22. Thus, the light emitting elements 1 and 4 are lighted up.

The semiconductor switch SW2 of the discharging device B closes during the period from when the source driver finishes the application of the voltage to any of the common lines L11 to L13 until when it starts the application of the voltage to any of the common lines L11 to L13 (one example of the period while the voltage is not applied to the common lines by the source driver), that is, during the period from when any of the semiconductor switches COM1 to COM3 closes until when any of the semiconductor switches COM1 to COM3 opens. Thus, the voltages of the common lines L11 to L13 are decreased to the predetermined value, or maintained at the predetermined value. Specifically, the voltage is decreased from 5 V to 2.8 V, or maintained at 2.8 V. Incidentally, the semiconductor switch SW1 of the charging device A, as well as the semiconductor switch SW2 of the discharging device B, closes, and therefore, it is possible to prevent the voltages of the common lines L11 to L13 from decreasing to the value lower than 2.8 V.

According to the first to the fifth embodiments, as explained thus far, the explanation has been given to the aspect of connecting all of the plurality of common lines L11 to L13 to the charging device and the discharging device. However, there may be the common line, out of the plurality of common line L11 to L13, that is not connected to the charging device and the discharging device. With the display apparatus having different dynamic lighting systems for the respective colors, that is, static (1/1 Duty) for the light emitting element (red), 1/2 Duty for the light emitting element (green) and the light emitting element (blue), for example, the charging device and the discharging device may not be connected to the common line (the common line L11, for example) to which the light emitting element (red) is connected, and the charging device and the discharging device may be connected to the common lines (the common lines L12 and L13, for example) to which the light emitting element (green) and the light emitting element (blue) are connected.

[A Display Apparatus According to a Sixth Embodiment]

Figure 6:
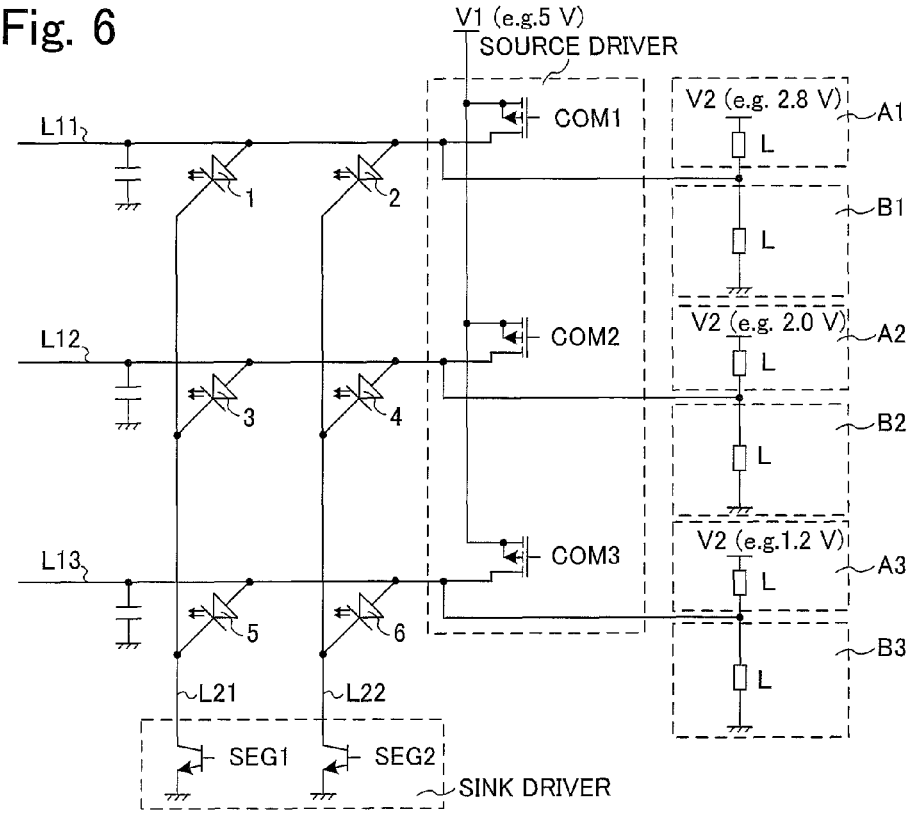
FIG. 6 is a circuit diagram of the display apparatus according to a sixth embodiment.

FIG. 6 is a circuit diagram of the display apparatus according to a sixth embodiment.

As illustrated in FIG. 6, the display apparatus according to the sixth embodiment is different from the display apparatus according to the first embodiment in that each of the charging devices A1 to A3 and the discharging devices B1 to B3 has the load L, and that the discharging devices B1 to B3 do not have the semiconductor switches SW1 to SW3.

With the display apparatus according to the sixth embodiment, it is possible to prevent the excessive reverse voltage from being applied to the light emitting elements 1 to 6, without the need for complex control, and to form the display apparatus by reducing the number of control signals and using a simple IC and a connector with a small number of pins.

The load L of each of the charging devices A1 to A3 and the discharging devices B1 to B3 may be formed by a resistor such as, for example, a fixed resistor, a variable resistor or the like. When the resistor such as the fixed resistor, the variable resistor or the like is used as the load L, it is possible to form the reliable display apparatus at a reasonable price. Incidentally, each of the charging devices A1 to A3 and the discharging devices B1 to B3 may include a Zener diode, a constant current diode, a rectifier diode and/or a light emitting diode, in addition to the load L.

When the load L of each of the charging devices A1 to A3 and the discharging devices B1 to B3 is large (3.9 kΩ and 5.1 kΩ, for example), the current flowing through the common lines is small (about 10 mA, for example), and therefore, the power consumption can be reduced. Meanwhile, when the load L of each of the charging devices A1 to A3 and the discharging devices B1 to B3 is small (390 kΩ and 510 kΩ, for example), the time required for increasing or decreasing the voltages of the common lines to the predetermined value is shortened. It should be noted that, with the display apparatus according to the sixth embodiment, the predetermined value is determined by a ratio of the loads L of the charging devices A1 to A3 to the loads L of the discharging devices B1 to B3. Therefore, the voltages of the common lines are maintained at the same values in both of the cases when the loads L of the charging devices A1 to A3 and the discharging devices B1 to B3 are 3.9 kΩ and 5.1 kΩ, respectively, and when the loads L of the charging devices A1 to A3 and the discharging devices B1 to B3 are 390 Ω and 510 Ω, respectively, for example.

FIG. 6 illustrates an example in which the voltages supplied by the voltage supply units V2 of the charging devices A1 to A3 are different from each other, but the voltages supplied by the voltage supply units V2 of the charging devices A1 to A3 may have the same value (refer to, for example, a second practical example that will be described later).

FIRST PRACTICAL EXAMPLE

Next, the display apparatus according to a first practical example will be explained. The display apparatus according to the first practical example is an example of the display apparatus according to the first embodiment.

With the display apparatus according to the first practical example, the 24 common lines and the 48 drive lines were arranged to cross each other, and the 1152 light emitting diodes (including three kinds of light emitting diode chips of red, green and blue) were respectively arranged at intersection points where the common lines and the drive lines were crossing each other.

The P-channel FET operating on 5 V was used as the source driver, and the NPN transistor with a constant current drive set at about 15 mA was used as the sink driver. The charging device has a low drop-out regulator (LDO regulator: an example of the series regulator), whose output voltage is 3.3 V, as an example of the voltage supply unit, and the N-channel FET and the resistor 270 Ω as an example of the load. Thereby, the voltages of the common lines become 5 V during a period while the voltage is applied by the source driver to drive the light emitting diodes, and the voltages of the common lines are maintained at 3.3 V (an example of the predetermined value) during a period while the voltage is not applied by the source driver because its parasitic capacitance is discharged.

The display apparatus according to the first practical example was allowed to drive dynamically at a duty ratio of 1/24. A scan period of the common lines was 86.8 μs, a period while the source driver was applying the voltage to the scanned common line was 76.8 μs, a period while the source driver was not applying the voltage was 10 μs and, within this period, the switching of the discharging device was 3 μs.

Oblique lighting was made on purpose, that is, the light emitting diodes arranged in an oblique direction were lighted-up out of the 1152 light emitting diodes arranged in matrix, in order to facilitate understanding whether the erroneous lighting was caused or not, and whether the reverse voltage was applied or not.

With regard to the display apparatus like this, the erroneous lighting was checked visually, and the reverse voltage was checked by an oscilloscope. The erroneous lighting of the light emitting diodes was not found, and the reverse voltage applied to the not-lighted light emitting diodes was kept low. Even when the voltage was not yet applied to the common lines by the source driver immediately after being turned on, the voltages of all the common lines were maintained at 3.3 V, and the reverse voltage applied to the light emitting diodes was kept low even during a period until the voltage was applied to all the common lines once (more than once) by the source driver.

Therefore, the display apparatus according to the first practical example can be judged as the high-quality display apparatus.

SECOND PRACTICAL EXAMPLE

Next, the display apparatus according to a second practical example will be explained. The display apparatus according to the second practical example is an example of the display apparatus according to the sixth embodiment.

With the display apparatus according to the second practical example, the 24 common lines and the 48 drive lines were arranged to cross each other, and the 1152 light emitting diodes (including the three kinds of the light emitting diodes of red, green and blue) were respectively arranged at the intersection points where the common lines and the drive lines were crossing each other.

A P-channel MOSFET was used as the source driver, and an NPN bipolar transistor with a constant current drive set at about 15 mA was used as the sink driver. The 3.9 kΩ resistor was used as the loads L of the charging devices A1 to A3, and the 5.1 kΩ resistor was used as the loads L of the discharging devices B1 to B3, and the voltages supplied from the voltage supply units V2 were 5 V that was the same as a source voltage of the P-channel MOSFET as the source driver. Thereby, the voltages of the common lines become 5 V during the period while the voltage is applied by the source driver to drive the light emitting diodes, and the voltages of the common lines are maintained at 2.8 V (an example of the predetermined value) during the period while the voltage is not applied by the source driver because the parasitic capacitance is discharged.

The display apparatus according to the second practical example of the present invention was allowed to drive dynamically at the duty ratio of 1/24. The scan period of the common lines was 86.8 μs, the period while the source driver was applying the voltage to the scanned common line was 76.8 μs, and the period while the source driver was not applying the voltage was 10 μs.

Further, the oblique lighting was made on purpose, that is, the light emitting diodes arranged in the oblique direction were lighted-up out of the 1152 light emitting diodes arranged in matrix, in order to facilitate the understanding whether the erroneous lighting was caused or not, and whether the reverse voltage was applied or not.

With regard to the display apparatus according to the second practical example like this, the erroneous lighting was checked visually, and the reverse voltage was checked by an oscilloscope. The erroneous lighting of the light emitting diodes was not found, and the reverse voltage applied to the not-lighted light emitting diode was kept low.

Therefore, the display apparatus according to the second practical example can be judged as the high-quality display apparatus.

FIRST COMPARATIVE EXAMPLE

Next, the display apparatus according to a first comparative example will be examined.

The configuration of the display apparatus according to the first comparative example was basically the same as that of the display apparatus according to the first practical example, except that the display apparatus was not provided with the discharging devices. Thereby, the parasitic capacitance of the common lines is not discharged, and the voltages of the common lines are not maintained at the predetermined values during the period while the voltage is not applied by the source driver.

As the display apparatus according to the first comparative example was provided with the charging devices, the voltage of 3.3 V or more was applied to the respective common lines while the voltage was not applied by the source driver (including the period immediately after being turned on), and the reverse voltage applied to the light emitting diodes was kept low.

Although the display apparatus according to the first comparative example was provided with the charging devices, but was not provided with the discharging devices. Therefore, when the oblique lighting was made, that is, the light emitting diodes arranged in the oblique direction were lighted-up out of the 1152 light emitting diodes arranged in matrix, the erroneous lighting was found in some of the light emitting diodes, each of which was connected to the same drive line as that of the lighted light emitting diode, and connected to the common line separated, by several common lines, from the common line of the lighted light emitting diode.

As the display apparatus according to the first comparative example is provided with the charging devices, but is not provided with the discharging devices as described above, it can be judged as the poor-quality display apparatus, even though the reverse voltage applied to the light emitting diodes can be kept low.

SECOND COMPARATIVE EXAMPLE

Next, the display apparatus according to a second comparative example will be examined.

The configuration of the display apparatus according to the second comparative example was basically the same as that of the display apparatus according to the first practical example, except that the display apparatus not provided with the charging devices was used. Thereby, the parasitic capacitance of the common lines is discharged by the discharging devices for the most part, during the period while the voltage is not applied by the source driver, and the voltages are decreased to almost zero, without being maintained at the predetermined values.

As the display apparatus according to the second comparative example was provided with the discharging devices, no erroneous lighting was found when the oblique lighting was made, that is, the light emitting diodes arranged in the oblique direction were lighted-up out of the 1152 light emitting diodes arranged in matrix.

However, the display apparatus according to the second comparative example was not provided with the charging devices. Therefore, the excessive reverse voltage was applied to the not-lighted light emitting diodes. Further, the excessive reverse voltage was also applied to the light emitting diodes immediately after being turned on.

As the display apparatus according to the second comparative example is provided with the discharging devices, but is not provided with the charging devices, as described above, it can be judged as the display apparatus with which the excessive reverse voltage is applied to the light emitting diodes.

Obviously, numerous modifications and variations of the present invention are possible in light of the above teachings. It is therefore to be understood that within the scope of the appended claims, the invention may be practiced otherwise than as specifically described herein.

What is claimed is:

1. A display apparatus comprising:

a plurality of common lines including a first common line;

a plurality of drive lines;

a plurality of light emitting elements connected to the plurality of common lines and the plurality of drive lines;

a source driver to apply a voltage to the plurality of common lines on a time-sharing basis;

a sink driver to draw a current from at least one drive line among the plurality of drive lines, the at least one drive line being connected to a light emitting element to be lighted-up among the plurality of light emitting elements;

at least one charging device connected to the first common line and configured to increase a voltage of the first common line to a predetermined value when the voltage of the first common line is lower than the predetermined value during a period while the source driver does not apply the voltage; and at least one discharging device connected to the first common line and configured to decrease the voltage of the first common line to the predetermined value when the voltage of the first common line is higher than the predetermined value during the period while the source driver does not apply the voltage, wherein said at least one discharging device is electrically connected to the first common line during a part of or all of a period when said at least one charging device is electrically connected to the first common line, and wherein said at least one charging device and said at least one discharging device are connected to each other by a discharging semiconductor switch such that when the discharging semiconductor switch is closed said at least one charging device and said at least one discharging device are electrically connected to each other and to the first common line, and the plurality of common lines do not form part of an electrically conductive path between the at least one charging device and the at least one discharging device.

2. The display apparatus according to claim 1, wherein the at least one charging device comprises a voltage supplier, and a charging semiconductor switch, one end of the charging semiconductor switch being connected to a side of the voltage supplier and another end of the charging semiconductor switch being connected to a side of the first common line.

3. The display apparatus according to claim 2, wherein one end of the discharging semiconductor switch is connected to a side of the first common line and another end of the discharging semiconductor switch is connected to a ground side.

4. The display apparatus according to claim 1, wherein one end of the discharging semiconductor switch is connected to a side of the first common line and another end of the discharging semiconductor switch is connected to a ground side.

5. The display apparatus according to claim 1, wherein the at least one charging device comprises a voltage supplier, and a resistor one end of which is connected to a side of the voltage supplier and another end of which is connected to a side of the first common line.

6. The display apparatus according to claim 5, wherein the at least one discharging device comprises a resistor one end of which is connected to a side of the first common line and another end of which is connected to a ground side.

7. The display apparatus according to claim 1, wherein the discharging device comprises a resistor one end of which is connected to a side of the first common line and another end of which is connected to a ground side.

8. The display apparatus according to claim 1, wherein two or more common lines among the plurality of common lines are connected to the at least one charging device.

9. The display apparatus according to claim 8, wherein two or more common lines among the plurality of common lines are connected to the at least one discharging device.

10. The display apparatus according to claim 1, wherein two or more common lines among the plurality of common lines are connected to the at least one discharging device.

11. The display apparatus according to claim 1, wherein the display apparatus comprises a plurality of charging devices and a plurality of discharging devices.

12. The display apparatus according to claim 1, wherein the display apparatus comprises a single charging device and a plurality of discharging devices.

13. The display apparatus according to claim 1, wherein the display apparatus comprises a plurality of charging devices and a single discharging device.

14. The display apparatus according to claim 1, wherein the display apparatus comprises a single charging device and a single discharging device.

15. The display apparatus according to claim 1, wherein the at least one charging device does not include a semiconductor switch disposed between a voltage supplier and the first common line.

16. The display apparatus according to claim 1, wherein the first common line is electrically connected to the at least one charging device when the discharging semiconductor switch is open and when the discharging semiconductor switch is closed.

17. A method for controlling a display apparatus, comprising:

applying, on a time-sharing basis, a voltage to a plurality of common lines connected to a plurality of light emitting elements of the display apparatus, the plurality of common lines including a first common line;

drawing a current from at least one drive line among a plurality of drive lines connected to the plurality of light emitting elements, the at least one drive line being connected to a light emitting element to be lighted-up among the plurality of light emitting elements;

increasing a voltage of the first common line to a predetermined value using a charging device when the voltage of the first common line is lower than the predetermined value during a period while the voltage is not applied by a source driver; and decreasing the voltage of the first common line to the predetermined value using a discharging device when the voltage of the first common line is higher than the predetermined value during the period while the voltage is not applied by the source driver, wherein the discharging device is electrically connected to the first common line during a part of or all of a period when the charging device is electrically connected to the first common line, and wherein the at least one charging device and the at least one discharging device are connected to each other by a discharging semiconductor switch such that when the discharging semiconductor switch is closed the at least one charging device and the at least one discharging device are electrically connected to each other and to the first common line, and the plurality of common lines do not form part of an electrically conductive path between the at least one charging device and the at least one discharging device.

* * * * *